US010737849B2

(12) United States Patent
Corners

(10) Patent No.: US 10,737,849 B2
(45) Date of Patent: Aug. 11, 2020

(54) ENCLOSURE WITH SLIDING AND PIVOTING COVER

(71) Applicant: Carnes Company, Inc., Pewaukee, WI (US)

(72) Inventor: Anthony Corners, Madison, WI (US)

(73) Assignee: CARNES COMPANY, INC., Pewaukee, WI (US)

( * ) Notice: Subject to any disclaimer, the term of this patent is extended or adjusted under 35 U.S.C. 154(b) by 343 days.

(21) Appl. No.: 15/389,631

(22) Filed: Dec. 23, 2016

(65) Prior Publication Data

US 2018/0178953 A1 Jun. 28, 2018

(51) Int. Cl.

| | |
|---|---|
| ***A45C 11/00*** | (2006.01) |
| ***B65D 43/16*** | (2006.01) |
| ***B65D 43/20*** | (2006.01) |
| ***B65D 85/68*** | (2006.01) |
| ***B65D 43/12*** | (2006.01) |
| ***B65D 5/64*** | (2006.01) |
| *E05D 15/58* | (2006.01) |
| *E05D 7/10* | (2006.01) |
| *E05D 3/02* | (2006.01) |

(52) U.S. Cl.

CPC ..... *B65D 43/165* (2013.01); *B65D 5/646* (2013.01); *B65D 43/12* (2013.01); *B65D 43/20* (2013.01); *B65D 85/68* (2013.01); *E05D 3/022* (2013.01); *E05D 7/1061* (2013.01); *E05D 15/58* (2013.01); *E05Y 2201/10* (2013.01); *E05Y 2900/602* (2013.01)

(58) Field of Classification Search

CPC ..... B65D 43/165; B65D 43/20; B65D 85/68; B65D 43/12; B65D 51/18; B65D 2251/0018; E05D 3/02; E05D 7/1044

USPC .... 220/811, 812, 813, 345.1, 816, 817, 810, 220/259.1, 254.9, 259.5, 345.4

See application file for complete search history.

(56) References Cited

U.S. PATENT DOCUMENTS

| | | | | |
|---|---|---|---|---|
| 2,304,898 | A * | 12/1942 | Dukehart, Jr. ..... | B65D 47/286 220/812 |
| 5,673,811 | A * | 10/1997 | Dickinson ..... | B65D 43/02 220/345.4 |
| 7,107,084 | B2 | 9/2006 | Duarte et al. | |
| 2002/0179487 | A1* | 12/2002 | Au ..... | A45C 11/16 206/752 |
| 2005/0146150 | A1* | 7/2005 | Niwa ..... | B60R 7/04 296/24.34 |
| 2010/0000052 | A1 | 1/2010 | Chung | |
| 2013/0285518 | A1 | 10/2013 | Stelmasik | |

* cited by examiner

*Primary Examiner* — Elizabeth J Volz

(74) *Attorney, Agent, or Firm* — Michael Best & Friedrich LLP

(57) ABSTRACT

An enclosure comprises a housing defining an opening, and a cover movable between a closed position, a slide open position, and a hinge open position. The hinge open position is rotationally displaced about a hinge axis from the closed position, and the slide open position is translationally displaced from the closed position along a slide path that is perpendicular to the hinge axis. There is a position between the closed position and the slide open position in which rotation of the cover is inhibited.

18 Claims, 4 Drawing Sheets

ENCLOSURE WITH SLIDING AND PIVOTING COVER

BACKGROUND

The present invention relates to enclosures having covers, such as enclosures for housing controls.

Enclosures are commonly used for housing a wide variety of items, such as control, machinery, meters, etc. In order to provide access to the item inside, enclosures often include a main housing with a cover or door that can be opened. For example, a cover can be attached to the main housing using removable fasteners, thus allowing the cover to be completely removed from the main housing. Alternatively, the cover can be attached to the main housing for sliding or pivoting movement, thereby allowing the cover to the opened while maintaining a connection between the cover and the main housing.

SUMMARY

The present invention provides an enclosure comprising a housing defining a hollow space and including an opening to the hollow space, and a cover coupled to the housing and movable relative to the opening between a closed position, a slide open position, and a hinge open position. The hinge open position is rotationally displaced about a hinge axis from the closed position, and the slide open position is translationally displaced from the closed position along a slide path that is skewed (e.g., perpendicular to) to the hinge axis.

In one embodiment, the housing includes a first hinge member (e.g., a hinge plate defining a hinge recess) and the cover includes a second hinge member (e.g., a hinge follower) adapted to engage the first hinge member when the cover is in the hinge open position. Preferably, the housing further includes a flange that guides the follower during movement of the cover between the closed position and the slide open position. The flange can be aligned with the hinge recess to facilitate movement of the follower from the flange to the hinge recess. If desired, the cover can further include a slide follower such that the flange guides the slide follower during movement of the cover between the closed position and the slide open position. Preferably, the slide follower is aligned with a notch in the flange when the hinge follower is positioned in the hinge recess.

The enclosure can be operated by positioning the cover in a slide open position engaged with the housing and with at least a substantial portion of the opening uncovered, sliding the cover along a slide path to a closed position with a substantial portion of the opening covered, and rotating the cover relative to the housing about a hinge axis that is skewed (e.g., perpendicular) relative to the slide path. In one embodiment, the housing includes a first hinge member and the cover includes a second hinge member, and the method further includes engaging the second hinge member with the first hinge member prior to the rotating step. The housing can further include a flange that guides the second hinge member during the sliding step. Preferably, the cover further includes a follower and the flange includes a notch, and the rotating step includes moving the follower through the notch.

Other aspects of the invention will become apparent by consideration of the detailed description and accompanying drawings.

DETAILED DESCRIPTION

Figure 1:
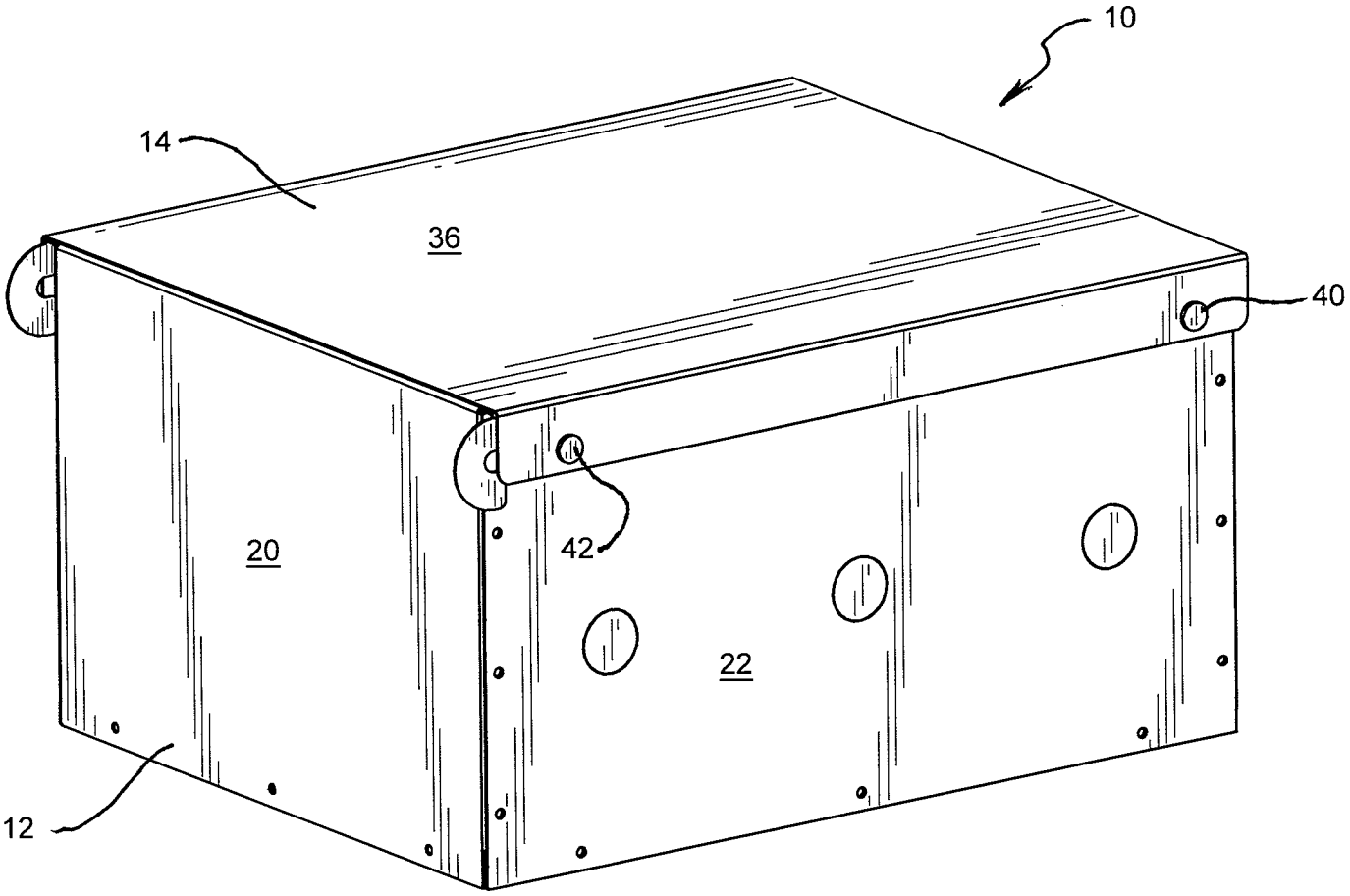
FIG. 1 is a perspective view of an enclosure having a main housing and a cover embodying the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-5 illustrate an enclosure 10 having a housing 12 and a cover 14. The housing 12 includes a bottom wall, a front wall 18, a rear wall 20, and two side walls 22 defining a hollow space 24 for containing objects, such as electrical components. The upper edges of the front, rear, and side walls 18, 20, 22 define an opening that provides access to the hollow space 24.

Opposing upper edges of the two side walls 22 each include a rail in the form of a flange 26 extending outward and downward. Each flange 26 extends substantially the entire length of the housing 12. Near a front of the housing 12, the flange 26 is interrupted to create a notch 28, the function of which will be described below.

The rear end of each flange 26 terminates in a hinge plate 30 that has a semi-annular shape and defines a hinge recess 32. The edge of the hinge plate 30 that defines the hinge recess 32 is aligned with a lower edge 34 of the flange 26 to create a smooth transition between the two surfaces.

The cover 14 includes a top wall 36 and skirts 38 extending downward from opposing side edges of the top wall 36. The top wall 36 and skirts 38 are dimensioned to fit over and cover the opening in the housing 12 with the skirts 38 in close proximity to the flanges 26. This arrangement allows sliding motion between the cover 14 and the housing 12, such as shown between FIG. 1 and FIG. 3.

Figure 5:
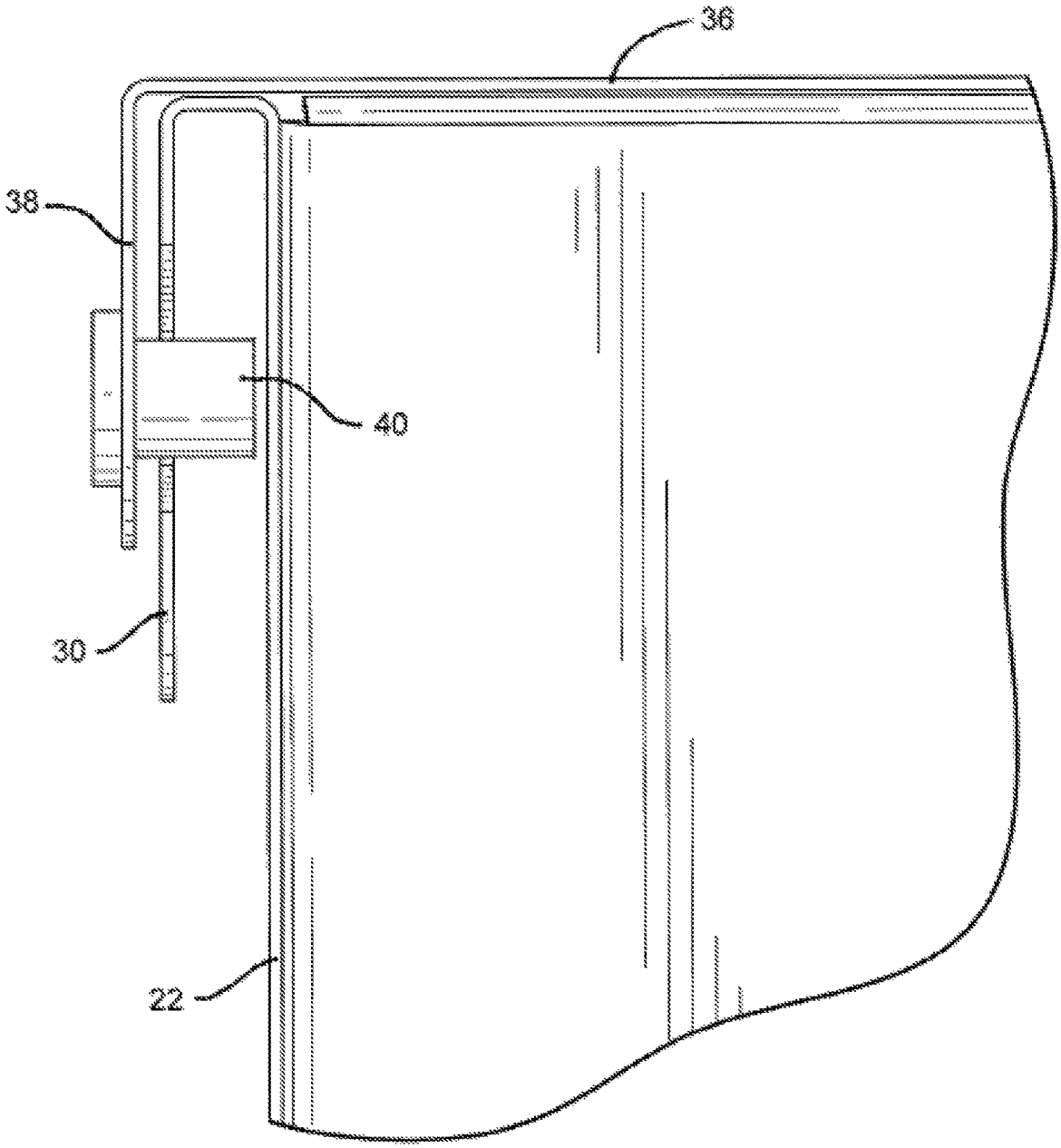
FIG. 5 is an enlarged front view of one portion of the enclosure.

Each skirt 38 of the cover 14 is provided with a front follower 40 (also called a slide follower) and a rear follower 42 (also called a hinge follower). Each follower 40, 42 extends inwardly from the skirt 38 toward the housing 12 to be positioned underneath the lower edge 34 of the corresponding flange 26, as best shown in FIG. 5. In this regard, the lower edge 34 of each flange 26 acts as a rail that guides the corresponding follower. This arrangement facilitates sliding of the cover 14 relative to the housing 12, while maintaining engagement of the cover 14 with the housing 12 due to the interaction between the followers 40, 42 and the flange 26 on the housing 12. In the illustrated embodiment, each follower 40, 42 is a rivet nut.

Referring to FIG. 1, the cover 14 can be engaged with the housing 12 in a closed position to substantially prevent access to the hollow space 24 inside the housing 12. If desired, the housing 12 and the cover 14 can be provided with hasps (not shown) that align in the closed position to allow insertion of a lock.

Figure 2:
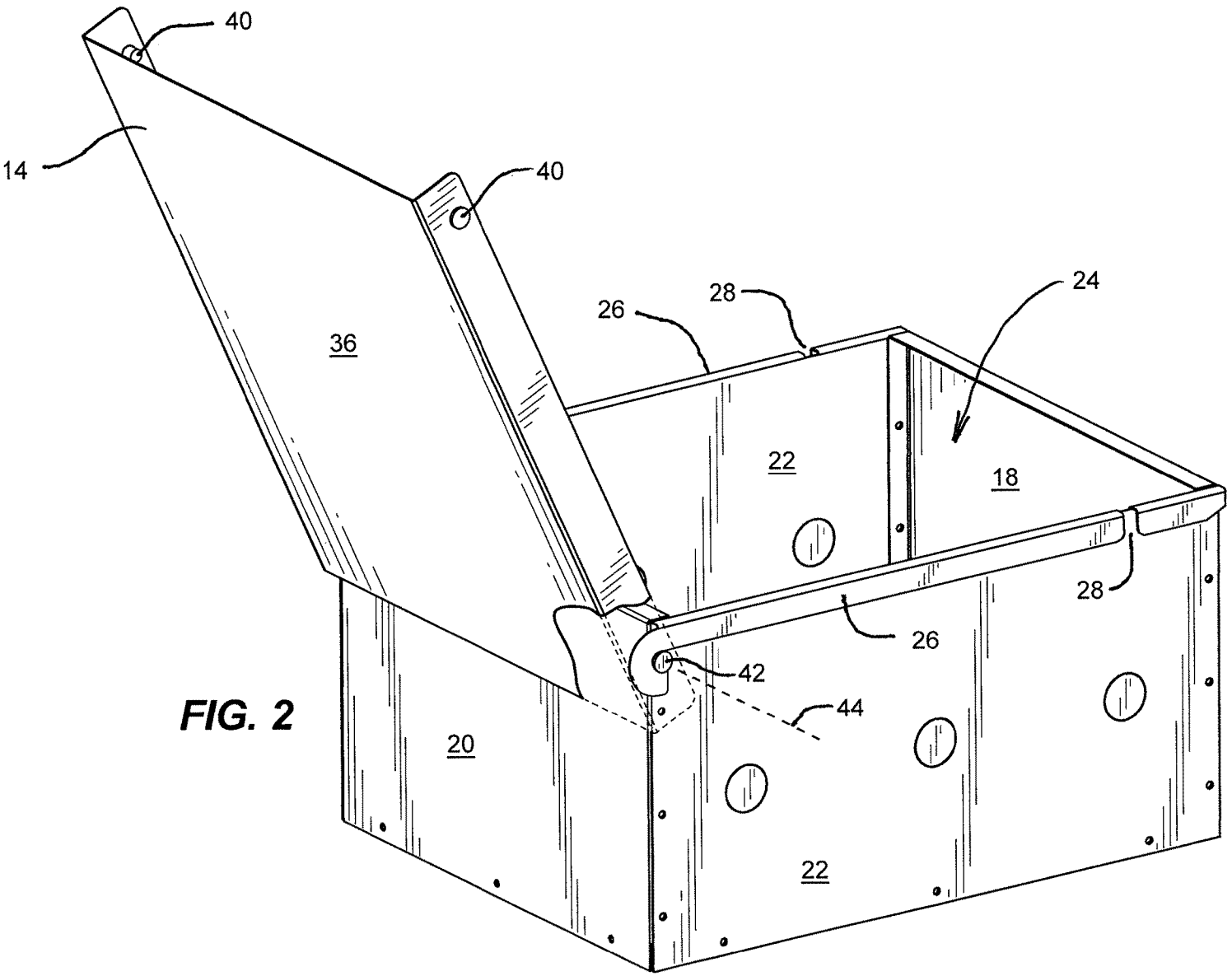
FIG. 2 is a perspective view of the enclosure of FIG. 1 with the cover in a pivot open position.
Figure 3:
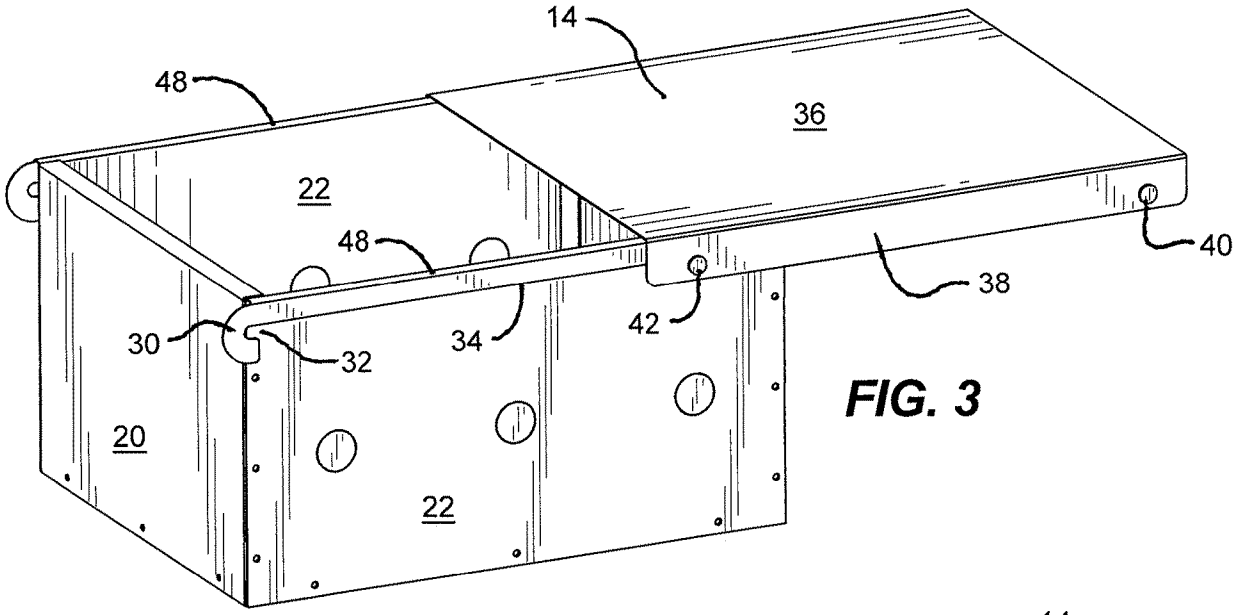
FIG. 3 is a perspective view the enclosure of FIG. 1 with the cover in a slide open position.

The cover 14 can be opened in two ways, as shown in FIGS. 2 and 3. Referring to FIG. 2, the cover 14 can be slide all the way to the rear of the housing 12 until the rear followers 42 engage the hinge plates 30 and are received in the hinge recesses 32. In this position, the front followers 40 are each aligned with (i.e., directly below) the notches 28 in the flanges 26. From this position, the front end of the cover 14 can be rotationally displaced upwardly about a hinge axis 44 created by the rear followers 42 and hinge plates 30. During this rotation, the front followers 40 will pass through the notches 28 in the flanges 26. In this hinge open position, the top wall 36 is engaged with or in close proximity to the hinge plates 30 to thereby prevent the rear followers 42 from falling out of the hinge recesses 32. The cover 14 can be rotated over center until the top wall engages the rear wall of the housing 12.

Figure 4:
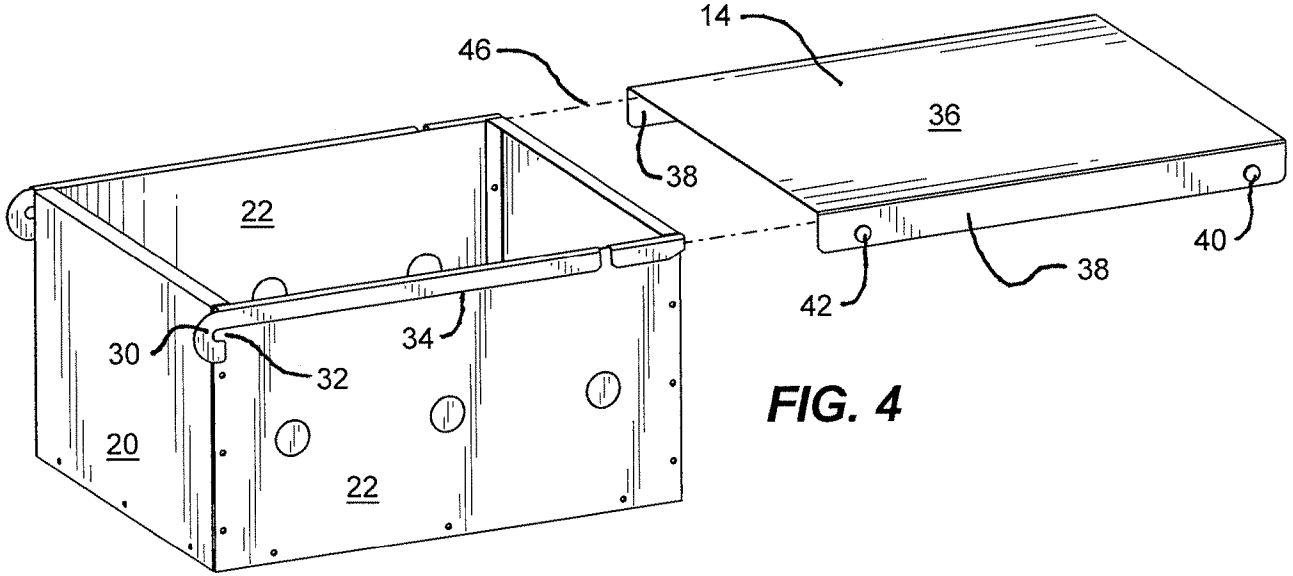
FIG. 4 is the perspective view of FIG. 3 with the cover removed from the main housing.

Referring to FIG. 3, the cover 14 can also be translationally displaced (e.g., slid open) along a slide path 46 in the front direction, which is substantially perpendicular to the hinge axis 44. In this configuration, the followers 40, 42 move away from the hinge plates 30 to thereby open the enclosure 10 between the rear wall 20 and a rear edge of the cover 14. In this slide open position, the top wall 36 is engaged with upper surfaces 48 of the flanges 26, which, in combination with engagement of the rear followers 42 with the lower edges 34 of the flanges 26, maintains the cover 14 in an orientation parallel to the flanges 26. If desired, the cover 14 can be completely removed by sliding it all the way out of engagement with the housing 12, as shown in FIG. 4.

Various features and advantages of the invention are set forth in the following claims.

The invention claimed is:

1. An enclosure comprising:

a housing defining a hollow space and including an opening to the hollow space;

a cover coupled to the housing and movable relative to the opening between a closed position, a slide open position, and a hinge open position, wherein the hinge open position is rotationally displaced from the closed position about a hinge axis positioned adjacent a distal end of the housing, wherein the slide open position is translationally displaced from the closed position along a slide path that is skewed to the hinge axis, wherein in the slide open position rotation of the cover is inhibited, and wherein there is a position between the closed position and the slide open position in which rotation of the cover is inhibited.

2. An enclosure as claimed in claim 1, wherein the housing includes a bottom wall and four side walls, and wherein the opening is defined between outer edges of the side walls.

3. An enclosure as claimed in claim 1, wherein the slide path is substantially perpendicular to the hinge axis.

4. An enclosure as claimed in claim 1, wherein the housing includes a first hinge member and the cover includes a second hinge member adapted to engage the first hinge member when the cover is in the hinge open position.

5. An enclosure as claimed in claim 4, wherein the first hinge member comprises a hinge plate defining a hinge recess, and wherein the second hinge member comprises a follower adapted to fit in the hinge recess to facilitate hinged movement between the cover and the housing.

6. An enclosure as claimed in claim 5, wherein the housing further includes a flange that guides the follower during movement of the cover between the closed position and the slide open position.

7. An enclosure as claimed in claim 6, wherein the flange is aligned with the hinge recess to facilitate movement of the follower from the flange to the hinge recess.

8. An enclosure as claimed in claim 6, wherein the follower comprises a hinge follower and wherein the cover further includes a slide follower, wherein the flange guides the slide follower during movement of the cover between the closed position and the slide open position.

9. An enclosure as claimed in claim 8, wherein the flange includes a notch and wherein the slide follower is aligned with the notch when the hinge follower is positioned in the hinge recess.

10. An enclosure as claimed in claim 5, wherein the cover includes a skirt and wherein the follower is mounted on the skirt.

11. A method of operating an enclosure having a housing and a cover, wherein the housing defines a hollow space and includes an opening to the hollow space, wherein the housing includes a first hinge member and a flange that guides a second hinge member during a sliding step, and wherein the cover includes the second hinge member, the method comprising:

positioning the cover in a slide open position engaged with the housing and with at least a substantial portion of the opening uncovered;

sliding the cover along a slide path toward a hinge axis adjacent a distal end of the housing, thereby positioning the cover in a closed position with a substantial portion of the opening covered;

inhibiting rotation of the cover relative to the housing at a position between the slide open position and the closed position;

engaging the second hinge member with the first hinge member prior to rotating the cover; and rotating the cover relative to the housing about the hinge axis that is skewed relative to the slide path.

12. A method as claimed in claim 11, wherein the hinge axis is substantially perpendicular to the slide path.

13. A method as claimed in claim 11, wherein the method further includes engaging the second hinge member with the first hinge member prior to the rotating step.

14. A method as claimed in claim 13, wherein the cover further includes a follower, wherein the flange includes a notch, and wherein rotating includes moving the follower through the notch.

15. An enclosure comprising:

a housing having walls defining a hollow space and including an opening to the hollow space, wherein at least two opposing walls each defines a rail on an outer surface of the wall;

a cover including two opposing followers coupling the cover to the housing, each follower being positioned to engage a corresponding rail, wherein the cover is movable relative to the opening between a closed position, a slide open position, and a hinge open position, wherein the hinge open position is rotationally displaced from the closed position about a hinge axis, wherein the slide open position is translationally displaced from the closed position along a slide path that is skewed to the hinge axis, wherein the housing defines opposing hinge recesses each adapted to receive one of the opposing followers when the cover is in the hinge open position; and wherein the hinge axis is positioned adjacent a distal end of the housing.

16. An enclosure as claimed in claim 15, wherein the cover includes two opposing skirts, each skirt supporting one of the opposing followers.

17. An enclosure as claimed in claim 16, wherein each skirt supports an additional follower spaced from the corresponding opposing follower.

18. An enclosure as claimed in claim 15, wherein each hinge recess is aligned with a corresponding rail to facilitate a smooth transition of the opposing followers from the rails to the hinge recesses.

* * * * *